US007588834B2

(12) United States Patent
Lowe

(10) Patent No.: US 7,588,834 B2
(45) Date of Patent: Sep. 15, 2009

(54) TRIMLESS FORGED PRODUCTS AND METHOD

(75) Inventor: Jason J. Lowe, N. Tonawanda, NY (US)

(73) Assignee: American Axle & Manufacturing, Inc., Detroit, MI (US)

( * ) Notice: Subject to any disclaimer, the term of this patent is extended or adjusted under 35 U.S.C. 154(b) by 275 days.

(21) Appl. No.: 11/705,165

(22) Filed: Feb. 9, 2007

(65) Prior Publication Data

US 2007/0137278 A1 Jun. 21, 2007

Related U.S. Application Data

(63) Continuation of application No. 11/124,533, filed on May 5, 2005, now Pat. No. 7,174,763.

(51) Int. Cl.
*B60B 27/00* (2006.01)

(52) U.S. Cl. ..... 428/582; 301/105.1

(58) Field of Classification Search ..... 301/6.8, 301/105.1, 106, 107; 428/582; 72/340, 359; 305/195; 29/889.23
See application file for complete search history.

(56) References Cited

U.S. PATENT DOCUMENTS

| | | | | |
|---|---|---|---|---|
| 1,454,508 | A * | 5/1923 | Eckert | 74/434 |
| 2,195,163 | A * | 3/1940 | Bott | 72/340 |
| 2,393,628 | A * | 1/1946 | Goldie et al. | 74/460 |
| 2,663,205 | A | 12/1953 | Allen | |
| 2,713,277 | A | 7/1955 | Kaul | |
| 2,835,960 | A * | 5/1958 | Rork | 29/889.23 |
| 3,540,316 | A | 11/1970 | Peterson | |
| 3,772,935 | A | 11/1973 | Dunn et al. | |
| 3,832,763 | A | 9/1974 | Schober | |
| 3,842,646 | A | 10/1974 | Kuhn | |
| 4,466,266 | A | 8/1984 | Gardner et al. | |
| 4,666,665 | A | 5/1987 | Hornsby et al. | |
| 4,672,729 | A | 6/1987 | Hoguchi et al. | |
| 5,516,376 | A | 5/1996 | Tsukamoto et al. | |
| 5,946,963 | A | 9/1999 | Suzuki et al. | |
| 6,351,886 | B1 | 3/2002 | Hasegawa | |
| 6,432,017 | B1 | 8/2002 | Shimomura | |
| 6,742,253 | B2 | 6/2004 | Geiman et al. | |
| 6,761,621 | B2 | 7/2004 | Shimomura | |
| 2004/0134720 | A1 * | 7/2004 | Niebling et al. | 188/18 A |

* cited by examiner

*Primary Examiner*—Jennifer McNeil
*Assistant Examiner*—Adam C Krupicka
(74) *Attorney, Agent, or Firm*—Harness, Dickey & Pierce, P.L.C.

(57) ABSTRACT

A method of manufacturing an irregularly shaped forging includes heating a billet to a predetermined temperature, placing the heated billet within the cavity of a die, advancing a punch into the cavity to begin to disperse the material into a plurality of radially extending extremities of the cavity and continuing to advance the punch into the die to force a portion of the material to enter predetermined clearance zones between the punch and the die to form an irregularly shaped forging having a plurality of axially extending flash portions.

14 Claims, 4 Drawing Sheets

TRIMLESS FORGED PRODUCTS AND METHOD

CROSS-REFERENCE TO RELATED APPLICATIONS

This application is a continuation of U.S. patent application Ser. No. 11/124,533 filed on May 5, 2005, now U.S. Pat. No. 7,174,763. The disclosure of the above application is incorporated herein by reference.

BACKGROUND AND SUMMARY OF THE INVENTION

The present invention generally relates to a method of forging steel components. More particularly, the present invention relates to hotformed irregularly shaped forgings and a method of forging irregularly shaped components.

Automobile and other industrial applications often require suspension or power transmission components to be structurally robust in order to react or transmit relatively high loads. Due to the high load requirements, these parts are often constructed from steel using a forging process. With the cost of steel rapidly increasing in today's market, it has become desirable to reduce the amount of steel scrap generated when manufacturing a steel structural component.

For certain irregularly shaped components such as hubs, spindles, flanges and gears, previously known forging methods often require subsequent trimming and/or machining operations to remove flash generated during the forging operation. In one example, a component with radially outwardly and circumferentially spaced apart protrusions is constructed via a forging process depicted in FIG. 1. The known process begins by shearing a length of substantially cylindrically shaped material to a predetermined length to form a billet 4. The billet 4 is heated and placed within a forging die to form a reduced length structure having an increased diameter called a bust 5. The bust 5 is placed into a subsequent forging die cavity to further shape the material into a finished forging 6. The finished forging 6 may include a trim ring (flashing) 7 comprised of radially extending flashing several millimeters thick. The flashing extends from a minor diameter of the part up to and sometimes beyond a major diameter of the finished component. The flashing may be formed as a ring or smaller several segments depending on the finished component design.

The flashing is necessary to assure that the extremities of the die cavity are filled with steel. As such, known forging dies include passageways for the steel to flow between and around the radially extending protrusions. While this process is effective to increase the likelihood that the areas of the die cavities including the radially extending protrusions are properly filled, this process creates a relatively large amount of scrap for each component produced. For example, typical flashing can range in weight from 50 grams to 400 grams or more, depending on the size of the part.

After the forging process is completed, the finished forging with flashing is transferred to a trimming and piercing station where the flashing 7 is removed using a trim die and a punch. The part also undergoes a piercing operation where a slug 8 of material is removed to form a through aperture, if desired. The removed material is scrap. After cooling, the trimmed part is cleaned by means of shot blasting or another suitable method. Lastly, the part is machined into a final shape.

While the above-described process is useful for manufacturing forged components, improvement in the part and process may be realized. For example, it may be advantageous to produce an irregularly shaped forging having a reduced quantity of flashing. A reduced amount of flashing may reduce the final component cost by reducing the scrap generated during the manufacturing process.

Furthermore, it may be advantageous to define a process for forging a component having a reduced number of process steps. A reduced number of steps may reduce the complexity and the time required to complete the forging process.

The forging method of the present invention eliminates the need for a trimming step as previously required and also greatly reduces the quantity of steel converted to scrap during the manufacturing process of forging an irregularly shaped component. Specifically, a method of manufacturing an irregularly shaped forging includes heating a billet to a predetermined temperature, placing the heated billet within a cavity of a die set having a punch and a die, advancing the punch of the die set into the cavity to begin to displace the material into a plurality of radially extending and circumferentially spaced apart extremities of the cavity, and continuing to advance the punch into the die to force a portion of the material to enter predetermined clearance zones between the punch and die. The predetermined clearance zones are circumferentially spaced apart and positioned between the extremities of the cavity to form an irregularly shaped forging pattern having a plurality of axially extending flash sections positioned between radially extending pad sections of the irregularly shaped forging.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
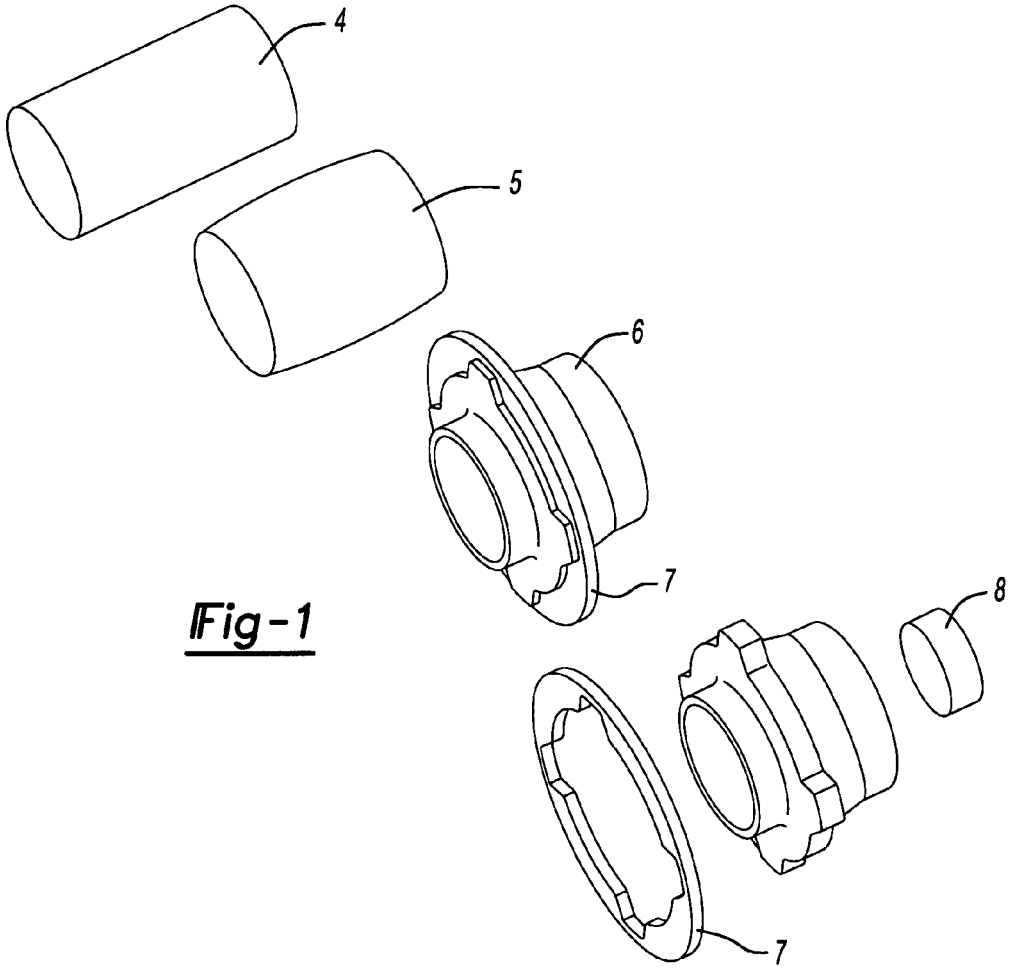
FIG. 1 is a perspective view depicting a series of intermediate forgings developed during a prior art process.
Figure 2:
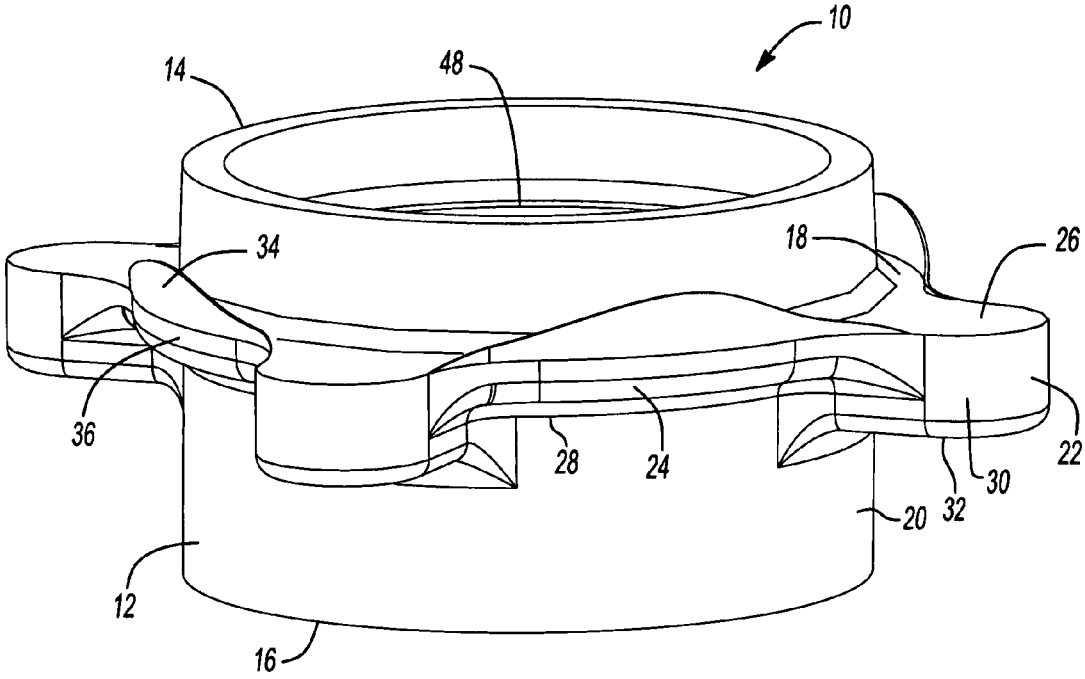
FIG. 2 is a perspective view of a finished forged hub constructed in accordance with the teachings of the present invention.

With reference to FIG. 2, a finish forged hub constructed in accordance with the principles of the present invention is identified at reference numeral 10. Hub 10 is merely an exemplary embodiment irregularly shaped forging useful to illustrate a method of forging irregularly shaped objects. It should be appreciated that any number of forged parts having radially extending and circumferentially spaced apart protrusions are contemplated as being within the scope of the present invention. Therefore, it is emphasized that the scope of the invention is defined by the claims and should not be limited to the configuration of the embodiment described hereinafter.

Hub 10 includes a substantially cylindrical hollow body 12 having a first end 14 and a second end 16. An integrally formed flange 18 radially outwardly extends from an outer surface 20 of body 12. Radially extending flange 18 is axially positioned between first end 14 and second end 16. Radially extending flange 18 includes a plurality of circumferentially spaced apart and radially extending pad portions 22. A plurality of web portions 24 are positioned between and integrally formed with the pad portions 22. Each web portion 24 extends between a pair of pad portions 22. Pad portions 22 and web portions 24 share a common upper surface 26. Web portions 24 have a reduced thickness when compared to pad portions 22. As such, web portions 24 each include a lower surface 28 opposite upper surface 26. Lower surface 28 runs out into a side wall 30 of each pad portion 22. Each pad portion 22 includes a bottom surface 32 which runs out into outer surface 20 of body 12. Due to the method of forming hub 10 described herein, side wall 30 will be formed as a substantially smooth, uninterrupted surface. A smooth surface provides an accurate locating feature as opposed to a trimmed surface. The as-forged side wall surfaces are typically used as a datum prior to machining the forging.

A plurality of flash portions 34 axially extend from upper surface 26 and an outer peripheral edge 36 of web portions 24. Flash portions 34 are substantially thin walled sections of material circumferentially spaced apart and positioned between each pad portion 22. Each flash portion 34 reaches a maximum height at approximately the mid-point of each web portion 24 and tapers to substantially zero height and blends into upper surface 26 as the flash portion 34 approaches one of pad portions 22. It should be appreciated that an axially extending flash portion may entirely circumscribe upper surface 26 without departing from the scope of the present invention.

Figure 3:
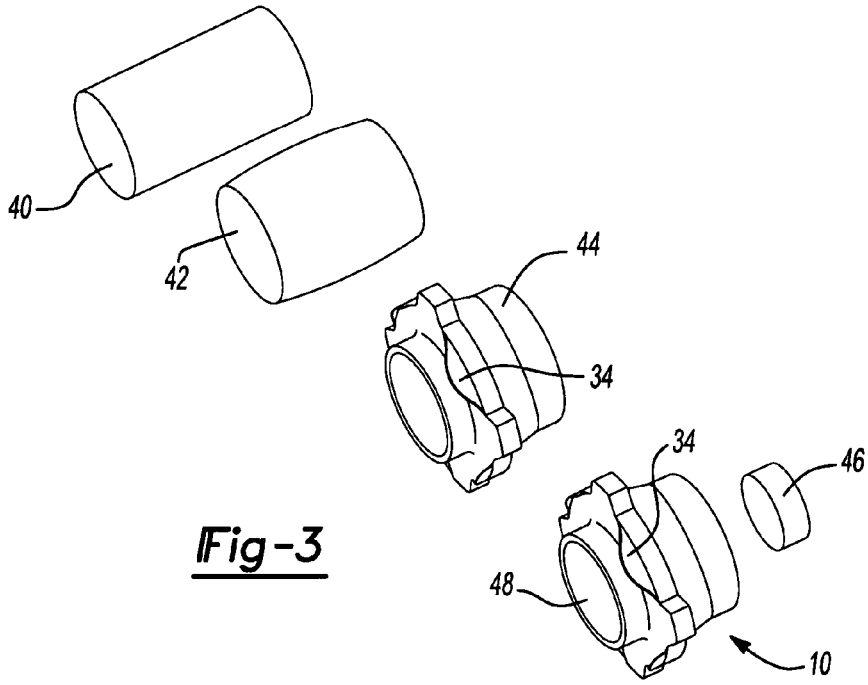
FIG. 3 is a perspective view depicting various stages of a forging process of the present invention.

FIG. 3 depicts various stages of forgings defined during the forging method of the present invention to construct hub 10. The process begins by cutting a length of material to form a billet 40. The billet 40 is heated and placed within a forging die to reduce the length of the billet and increase its diameter to form a bust 42. Bust 42 is subsequently placed in a finish die where a finished forging 44 is formed. Finished forging 44 is transferred to a pierce die where a slug of material 46 is removed to define a through aperture 48. The flashing 34 is removed in a subsequent machining operation to define a finished part (not shown). One skilled in the art will appreciate that the process of the present invention as depicted in FIG. 3 does not include the step of trimming to remove radially extending flashing with a trim die and punch. Furthermore, it should be appreciated that the quantity of material dedicated to scrap, shown as flashing 34, is substantially reduced compared to the quantity of material defining trim ring 7.

Figure 4:
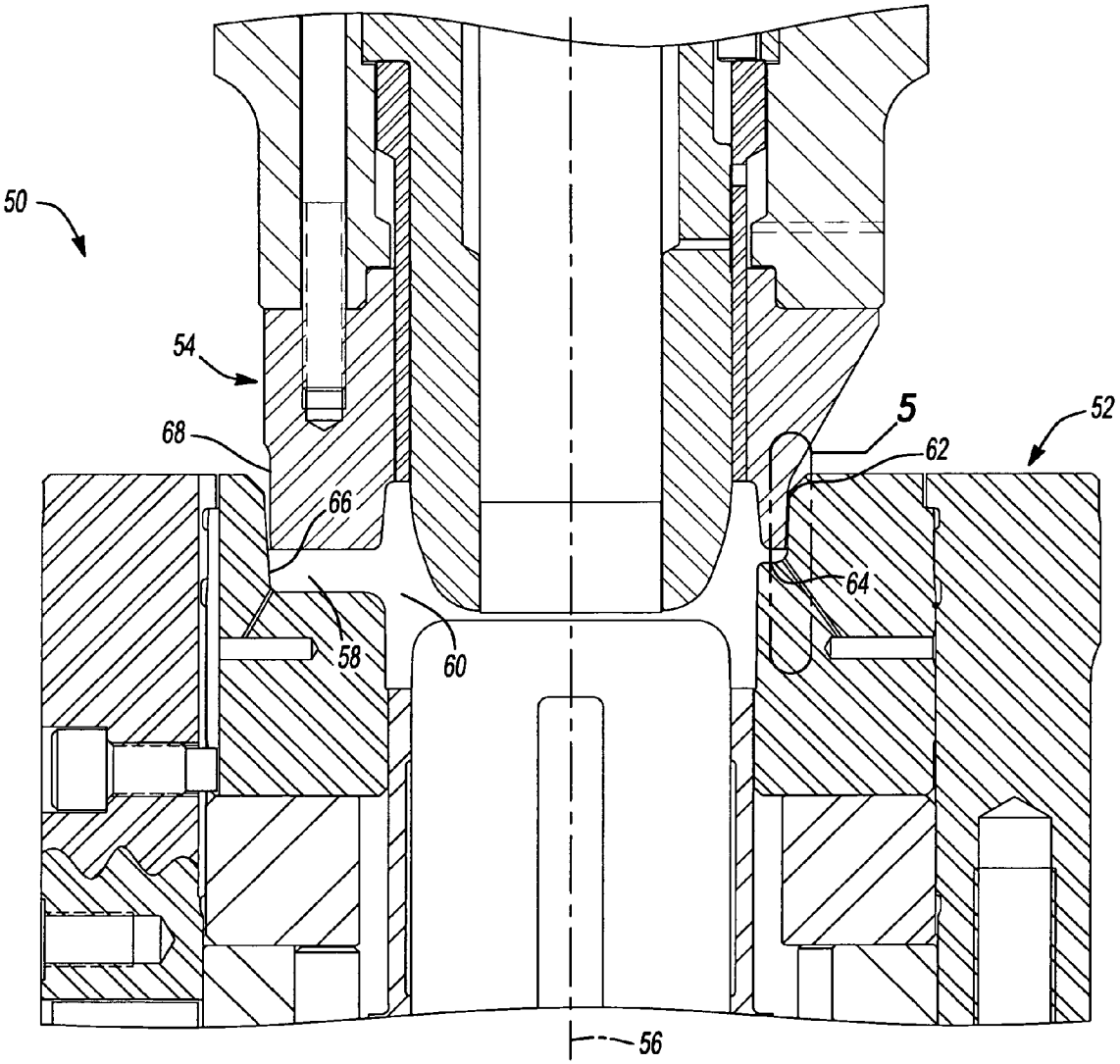
FIG. 4 is a cross-sectional view of an exemplary punch and die assembly operable to create the finished hub depicted in FIG. 2.

FIG. 4 depicts a punch and die assembly 50 having a die assembly 52 and a punch assembly 54 operable to form finished forged hub 10. Punch assembly 54 is movable relative to stationary die assembly 52 to form hub 10. FIG. 4 is drawn to depict a portion of the tooling that forms one of the web portions 24 on the right side of centerline 56. The portion of the tooling that forms one of the pad portions 22 is shown on the left side of centerline 56.

Figure 5:
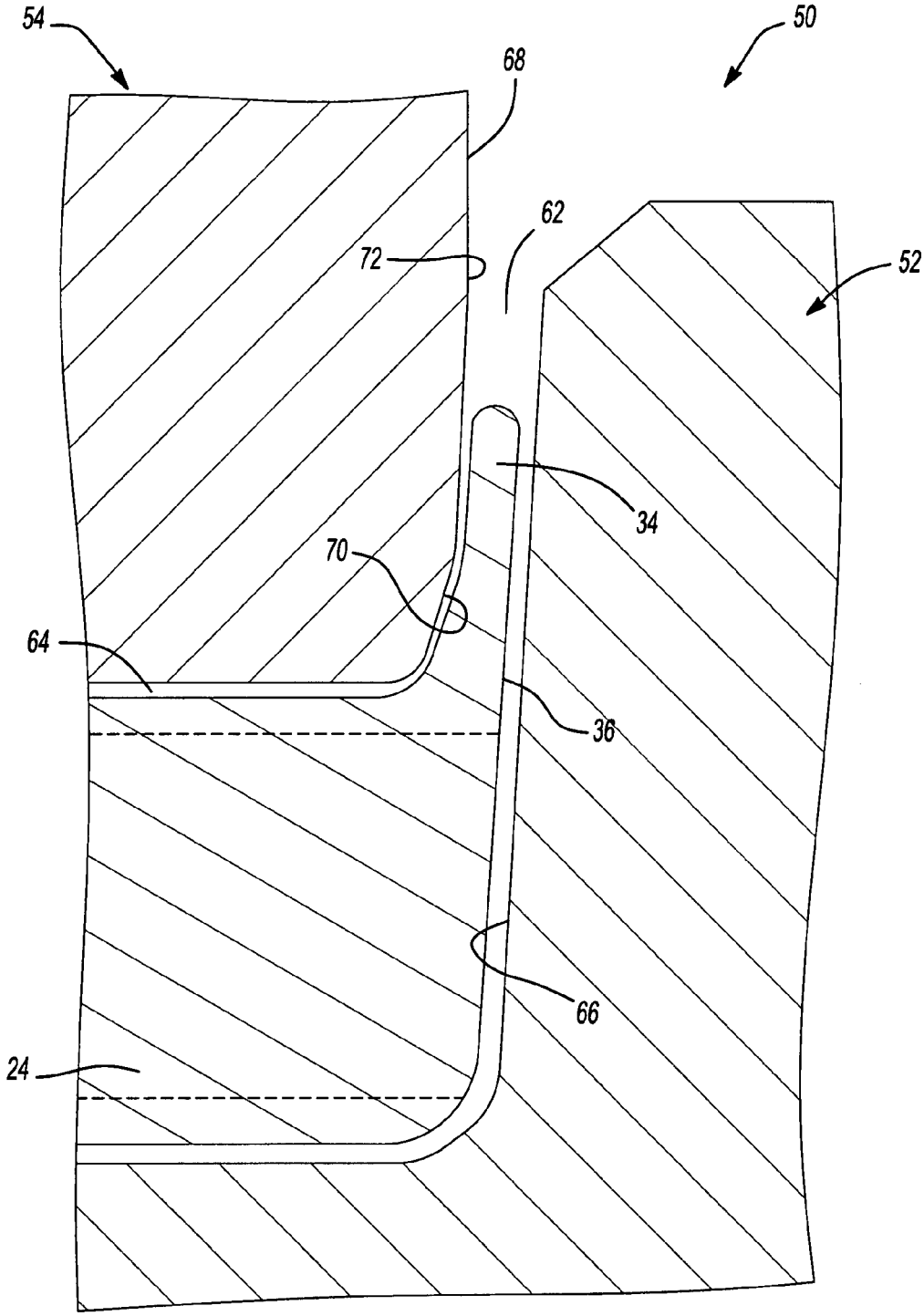
FIG. 5 is a partial enlarged view of the punch and die of FIG. 4 having the finished hub positioned therein.

FIG. 5 is an enlarged view of a portion of punch and die assembly 50 as depicted by the phantom outline in FIG. 4. Punch and die assembly 50 is constructed to include extremities 58 of a cavity 60 defined by the area between punch assembly 54 and die assembly 52 when the punch and die assembly 50 is in the closed position as depicted in FIG. 4. Extremities 58 define the shape of pad portions 22. To accomplish such a large change is in shape from bust 42 to finished hub 10 without forming a large radially extending trim ring, a pocket 62 is provided between punch assembly 54 and die assembly 52. Pocket 62 accepts material that has filled a portion 64 of cavity 60 while material continues to be forced within extremity portion 58 of cavity 60 to form pad portions 22.

It should be appreciated that die assembly 52 includes an inner wall 66 which defines the shape of side wall 30 and outer peripheral edge 36. An outer wall 68 of punch assembly 54 is overlapped by a portion of wall 66 to assure that the forged material is not allowed to radially extend beyond outer surface 36 and that only an axially extending flash portion 34 may be formed. To allow punch assembly 54 to release from hub 10, outer wall 68 includes a lead portion 70 having a taper ranging from about 4-15 degrees from vertical. A tapered portion 72 is positioned adjacent lead portion 70. Tapered portion 72 is angled from about 0-4 degrees from vertical to allow punch assembly 54 to release from flash portion 34.

For the hub embodiment depicted, the radial clearance between outer wall 68 and inner wall 66 ranges from about 0.1 mm to 1.5 mm. This clearance is sufficient to allow axial flash portions 34 to form while pad portions 22 are being forged. Furthermore, pocket 62 is small enough to allow removal of this material with a lathe in a turning operation. The small clearance value minimizes the quantity of steel that will be scrapped once the machining (lathe, mill or grind) operation has been completed.

Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. A forged component, comprising:

a body; and a radial flange surrounding and integrally formed with said body, said flange having radially extending pad portions, web portions interconnecting said pad portions, and flash portions extending from said web portion which are oriented transverse to said pad portions, and wherein said pad portions and said web portions have a common planar surface with said flash portions extending from said planar surface.

2. The forged component of claim 1 wherein each one of said flash portions is a thin walled section of material positioned between a pair of adjacent pad portions.

3. The forged component of claim 1 wherein said flash portions are adapted to be removed via a machining operation to produce a forged hub.

4. The forged component of claim 1 wherein said web portions have a reduced thickness relative to said pad portions.

5. A forged component, comprising:

a body; and a flange integrally formed with and radially extending outwardly from said body, said flange including a plurality of spaced apart and radially extending pad portions, web portions having a reduced radial dimension relative to said pad portions and which are located between adjacent pad portions, and flash portions axially extending from said web portions and located between at least two of said pad portions.

6. The forged component of claim 5 wherein said flange includes a first planar surface, said flash portions axially protruding above said first planar surface.

7. The forged component of claim 6 wherein said flange includes a second planar surface opposite said first planar surface and an edge surface extending between said first and second planar surfaces, said edge surface is free of radially extending flashing or material adapted to be trimmed.

8. A forged component, comprising:

a body;

at least two protrusions extending radially from said body;

a web portion extending from said body and interconnecting said protrusions, said web portion having a radial dimension that is less than a radial dimension of each of said protrusions; and a flash portion extending from said web portion transverse to said protrusions.

9. The forged component of claim 8 wherein said flash portion extends axially relative to said body.

10. The forged component of claim 8 wherein said web portion has a thickness dimension that is less than a thickness dimension for said protrusions.

11. The forged component of claim 8 wherein said protrusions and said web portion define a flange formed integrally with said body and having a common flange surface, and wherein said flash portion extends outwardly from said flange surface.

12. A forged component, comprising:

a cylindrical body having a central aperture;

an irregularly-shaped flange extending radially from an outer surface of said body, said flange having a plurality of pad portions, web portions interconnecting adjacent pad portions, and flash portions extending traversely from said web portions, wherein said web portions have a thickness dimension that is less than a thickness dimension of said pad portions, and wherein said web portions have a radial dimension that is less than a radial dimension of said pad portions relative to said outer surface of said body.

13. The forged component of claim 12 wherein said pad portions and said web portions define a common planar surface, and wherein said flash portions extends outwardly relative to said common planar surface.

14. The forged component of claim 12 wherein said pad portions and said web portions define a continuous edge surface with said flash portions located radially inward of said edge surface.

* * * * *